US011143490B2

(12) United States Patent
Zimmermann

(10) Patent No.: US 11,143,490 B2
(45) Date of Patent: Oct. 12, 2021

(54) ADJUSTING ELEMENT FOR ADJUSTMENT OF A LINE OF SIGHT OF AN OPTICAL SIGHTING MECHANISM, AND TELESCOPIC SIGHT WITH THE ADJUSTING ELEMENT AND WEAPON WITH THE TELESCOPIC SIGHT, AND METHOD FOR ADJUSTING THE LINE OF SIGHT

(71) Applicant: Swarovski-Optik KG., Absam (AT)

(72) Inventor: Andreas Zimmermann, Fulpmes (AT)

(73) Assignee: Swarovski-Optik KG.

( * ) Notice: Subject to any disclaimer, the term of this patent is extended or adjusted under 35 U.S.C. 154(b) by 451 days.

(21) Appl. No.: 15/906,519

(22) Filed: Feb. 27, 2018

(65) Prior Publication Data

US 2018/0252498 A1 Sep. 6, 2018

(30) Foreign Application Priority Data

Feb. 27, 2017 (AT) ..... A 50157/2017

(51) Int. Cl.
*F41G 1/38* (2006.01)

(52) U.S. Cl.
CPC ..... *F41G 1/38* (2013.01)

(58) Field of Classification Search
CPC ..... F41G 1/38; F41G 3/08; F41G 11/00
See application file for complete search history.

(56) References Cited

U.S. PATENT DOCUMENTS 3,169,461 A 2/1965 Erbe et al.
7,612,952 B2 11/2009 Schafer
7,624,526 B2 * 12/2009 Paasikivi ..... F41G 1/38 42/111
8,001,714 B2 * 8/2011 Davidson ..... F41G 1/38 42/122
8,928,878 B2 1/2015 Jaeschke et al.
9,354,438 B2 5/2016 Ingenito et al.
2003/0145505 A1 * 8/2003 Kenton ..... F41G 1/38 42/135

(Continued)

FOREIGN PATENT DOCUMENTS

AT 516059 A4 2/2016
EP 1843122 A2 10/2007

(Continued)

*Primary Examiner* — Gabriel J. Klein

(74) *Attorney, Agent, or Firm* — Lerner, David, Littenberg, Krumholz & Mentlik, LLP

(57) ABSTRACT

The invention relates to an adjusting element for a telescopic sight, with a base, a rotary actuating element, a display element that has along its circumference at least one scale visible from the outside with multiple scale markings that are read off in reference to a reference marking, wherein the display element acts to display the current setting of the rotary actuating element. The individual scale markings represent values of a main parameter, whereby at least two scale levels are formed to display a first ancillary parameter, which are placed axially spaced apart from each other on the display element, whereby the scale markings of the individual scale levels that represent the same value of the main parameter are displaced by a difference angle to each other and a first ancillary parameter can be set using the individual scale levels.

20 Claims, 6 Drawing Sheets

(56) References Cited

U.S. PATENT DOCUMENTS

| | | | | |
|---|---|---|---|---|
| 2006/0278035 | A1* | 12/2006 | Casas | F41G 1/38 74/553 |
| 2008/0289239 | A1* | 11/2008 | Menges | G02B 23/14 42/125 |
| 2009/0064561 | A1* | 3/2009 | Piltonen | F41G 1/38 42/119 |
| 2014/0137458 | A1* | 5/2014 | Crispin | F41G 1/38 42/119 |
| 2015/0268001 | A1* | 9/2015 | Porter | F41G 1/38 42/130 |
| 2016/0040959 | A1* | 2/2016 | Davidson | F41G 1/38 42/122 |
| 2016/0169672 | A1 | 6/2016 | Ottl et al. | |
| 2016/0178323 | A1* | 6/2016 | Ottl | F41G 1/38 74/532 |
| 2017/0205195 | A1* | 7/2017 | Sheets, Jr. | G02B 27/36 |

FOREIGN PATENT DOCUMENTS

| | | | | |
|---|---|---|---|---|
| EP | 2684005 | A1 | 1/2014 | |
| EP | 2848887 | A2 | 3/2015 | |
| FR | 758208 | A * | 1/1934 | F41G 11/00 |
| JP | S56130905 | | 10/1981 | |

* cited by examiner

ADJUSTING ELEMENT FOR ADJUSTMENT OF A LINE OF SIGHT OF AN OPTICAL SIGHTING MECHANISM, AND TELESCOPIC SIGHT WITH THE ADJUSTING ELEMENT AND WEAPON WITH THE TELESCOPIC SIGHT, AND METHOD FOR ADJUSTING THE LINE OF SIGHT

BACKGROUND OF THE INVENTION

The invention relates to an adjusting element for adjustment of a line of sight of an optical sighting mechanism, in particular a riflescope, as well as a riflescope equipped with the adjusting element and a weapon equipped with the riflescope. The invention further relates to a method for adjusting a line of sight of an optical sighting mechanism.

EP 2 848 887 A2 discloses a riflescope with a rotating turret that has a rotary actuating element and an indicator element.

AT 516 059 A4 discloses another riflescope with a rotating turret that has a rotary actuating element and an indicator element.

Other riflescopes are disclosed in EP 1 843 122 B1 and EP 2 684 005 B1.

BRIEF SUMMARY OF THE INVENTION

In the riflescopes known from the prior art, the rotating turret executes a correction if current shot conditions deviate from sighting in conditions. The rotary actuating element tilts the line of sight by an angle relative to the barrel of the gun. The rotary actuating element is coupled to an indicator element to which is attached a scale from which the current angle setting can be read off. The resolution of the scale usually defines the smallest possible setting increment. In addition, it is usually provided that the rotary actuating element is coupled to a detent ring that can give acoustic or haptic feedback to the user and can additionally fix the rotary actuating element in its current position against unwanted rotation. The resolution of the detent ring is in most cases identical to the resolution of the scale. The rotation of the rotary actuating element by an incremental step of the detent ring, also called a click, tilts the line of sight by a specific angle value. The angle value is usually stated in the form of an adjustment of the line of sight by a specific lateral displacement at a specific distance, such as 1 cm/100 m or 0.5 cm/100 m, or in minutes of angle or MOA or a fraction of a MOA. It can be read out from ballistics tables related to a gun how many clicks are needed to compensate for deviations from sighting in conditions.

The most important sighting in conditions include the target distance, the air pressure and ambient temperature upon firing, the cartridge used (charge), including condition of the projectile and loading, i.e. all factors relevant to the exterior ballistics such as in particular the ballistic coefficient (BC) or the muzzle velocity of the projectile from the barrel (v0). Other sighting in conditions are, for example, the geographic location of the shooting range, and many other factors. Usually the target shot at is placed solely at a horizontal distance. A distance that differs from the sighting in distance yields the larges effect of a deviation in the impact point height.

To compensate for the impact point shift caused because a shot distance differs from the sighting in distance, the shooter must make corrections during sighting for a successful shot. If the shooter is practiced and if the shot distance does not deviate that much from the sighting in distance, these corrections can be made based on experience by adjusting the turret by a few clicks or by shifting the point of aim on the target. For example, if the sighting in distance is 100 m, an additional 5-10 clicks or 3-5 MOA are typically needed for ranges of fire of up to 200 m. In case of larger deviations in the distance, especially over 200 m shot distance at a sighting in distance of 100 m, simple pre-calculated tables are needed that are e.g. glued onto the gun stock for quick viewing.

If a second parameter value, such as cross-wind or a specific shot angle, e.g. if the target is elevated above the horizontal, is to be taken into account in order to allow for the required correction based on the shot distance, this usually leads to a problem due to a lack on experience about the additional correction value to be accommodated and relevant and comprehensive ballistics tables are usually not available. Because of their complexity, comprehensive ballistics tables also have the disadvantage that they are difficult to read and errors in reading are not unusual in the field and under stress.

It was the aim of the present invention to overcome the disadvantages of the prior art and provide an adjusting element for a riflescope and/or a riflescope equipped with the adjusting element using which a second parameter can easily be taken into account and compensated for.

This aim is achieved by an apparatus as described in the claims.

The invention specifies an adjusting element for a riflescope with a base, a rotary actuating element that can be rotated around a rotational axis relative to the base, and an indicator element. The indicator element can be rotated around the rotational axis relative to the base and has along its length at least one scale visible from the outside with multiple scale markings which are to be read off in reference to a reference marking, whereby the indicator element is coupled to the rotary actuating element and the reference marking is coupled to the base and the indicator element indicators the current setting of the rotary actuating element. The individual scale markings represent values of a main parameter, whereby at least two scale levels are formed to indicator an ancillary parameter value, which scale levels are placed axially spaced apart from each other on the indicator element, whereby the scale markings of the individual scale levels that represent the same value of the main parameter are displaced by a difference angle to each other and a first ancillary parameter can be set using the individual scale levels.

The invented adjusting element has the advantage that a variable ancillary parameter value allows an additional parameter that influences the main parameter value to be taken into account. This in particular brings advantages if the required setting of the main parameter, for example to change the shot distance, is performed by the user based on experience or simple tables. The ancillary parameter, for example a shot angle, can be set simply and without calculation using the scale for the ancillary parameter.

In particular, it is provided that the main parameter represents MOA or a fraction of a MOA or a specific adjustment such as 1 cm/100 m. The setting of the main parameter is therefore a purely incremental angle adjustment of the line of sight to the barrel. In order to be able to take into account changes in the sighting in conditions, the required correction of the main parameter should be calculated or read out from an appropriate table.

The first ancillary parameter usually represents the deviation of the line of sight under certain conditions that vary from the sighting in conditions. For example, the first ancillary parameter may act to correct a deviation in the shot angle relative to the horizontal. This is an absolute value that, aside from the shot angle, is valid for the same conditions as the standard sighting in conditions. In other words, the first ancillary parameter already contains the information in a multidimensional ballistics table. If a certain weapon-charge combination was not discharged under standard conditions, but for example at a distance that differs from the standard sighting in distance, the values of the first ancillary parameter may no longer be exactly correct. Often, however, these deviations are so small that they are negligible and the representation of the first ancillary parameter remains valid in this case as well.

A typical sighting in condition for a specific weapon with a specific charge under specific environmental conditions, e.g. standard ICAO atmosphere, is called a standard sighting in condition. In order to take the ancillary parameters into account correctly, it may be necessary to calibrate the indicator element for a specific weapon under the sighting in conditions typical for it.

The discussed aspects relating to the first ancillary parameter can also apply to the second ancillary parameter.

In particular, it can be provided for the first ancillary parameter to act to correct a deviation of the shot angle relative to the horizontal with the elevation turret. Alternately, it can, for example, be provided for the first ancillary parameter to act to correct a cross-wind with the side turret.

It can further be provided for the second ancillary parameter to act to correct a deviation of the shot angle relative to the horizontal.

Of course, all parameters that influence the trajectory of the projectile and differ from the main parameter can be represented in the ancillary parameters.

It can further be useful if the indicator element is arranged directly on the rotary actuating element. The advantage here is that this measure allows the adjusting element to have a simple design. For example, it can be provided for the rotary actuating element to be designed in the shape of a rotating disc with a cylindrical outer sheath surface and for the indicator element to be, for example, printed on the cylindrical outer sheath surface. It can also be provided for the indicator element to be incised, engraved, or etched into the cylindrical outer sheath surface or applied to the rotary actuating element in another form. It can further be provided for the indicator element to be designed in the form of a film that is affixed to the rotary actuating element.

It can furthermore be provided for the scale markings to be designed in the form of curves that extend beyond the individual scale levels. The advantage here is that the curves that extend beyond the individual scale levels connect the individual point values to each other. This makes the indicator element more readable.

In addition, it can be provided for the relative angle between two scale markings of a first scale level to be a different size to a relative angle between two scale markings of a second scale level. This measure allows it to be taken into account, for example, that a change in the shot angle at the sighting in distance has a different effect than a change of the shot angle at a distance that differs from the sighting in distance.

Alternately, it can be provided for the relative angle between two scale markings to be the same size on different scale levels. This makes it possible for the curves to run parallel to each other. Thus such a form of scale marking can also be suitable for a rotary actuating element that is designed for multiple turns. Such an embodiment variation can in particular be advantageous in cases when the necessary adjustments on the individual scale levels are negligibly small so that high precision can nevertheless be achieved.

Also advantageous is a design that makes it possible for auxiliary lines parallel to the axis to be arranged on the indicator element such that they extend at least some scale markings from the different scale levels towards the reference marking. The advantage here is that this measure makes it easier to read off the indicator element. In particular, this allows scale markings to be read out more easily from the scale levels distant from the reference marking.

In a further development, it is possible for the individual scale levels to be characterized by axially spaced apart circumferentially running ancillary scale markings. The advantage here is that the ancillary scale markings can make the individual scale levels visible.

It can further be useful if the scale markings and the auxiliary lines parallel to the axis and/or the ancillary scale markings have a different color and/or a different line thickness. The advantage here is that this measure makes the indicator element clear and easy to read.

In addition, it can be provided for the reference marking to have a second scale, allowing a second ancillary parameter to be set, whereby the second scale of the reference marking acts to offset the zero point based on the second ancillary parameter. The advantage here is that this measure can set not only one ancillary parameter but a second ancillary parameter at the same time.

It can further be provided for the resolution of the first ancillary parameter to be chosen such that the difference angle between two scale markings from two neighboring scale levels that represent the same value of the main parameter is the same size or larger by an integer multiple than the resolution of the scale marking of the main parameter. The advantage here is that this measure causes the scale markings from different scale levels to lie on top of a line parallel to the axis and makes it easier to read off the set scale value. In addition, this makes it possible for the scale markings on each scale level to coincide with a detent position of the rotary actuating element. To achieve this, it may, for example, be necessary for unconventional values such as a shot angle of 7.4°, 14.8°, etc. to be indicated in the individual scale levels.

In a special design, it is possible for a transparent reading aid to be formed that is coupled to the base and extends outside the indicator element beyond the individual scale levels of the indicator element, whereby the reference marking is designed in the form of a stripe parallel to the axis applied on the reading aid. The advantage here is that such a reading aid allows the individual values of the different scale levels to be read off easily.

An advantageous further development can provide for the ancillary scale markings of the individual scale levels to be formed on the reading aid.

It can in particular be advantageous if the reading aid is arranged on a swivel that can be rotated relative to the base, allowing the second ancillary parameter to be set. In this way a second parameter value can be set even when the reading aid is used.

It can further be provided that the indicator element be formed out of an at least partially transparent material on which the individual scale markings are applied and that the reference marking take the form of a stripe parallel to the axis arranged behind the indicator element that extends beyond the individual scale levels of the indicator element.

It can further be provided that the indicator element be exchangeable and different indicator elements with different scale levels be attachable to the adjusting element. The advantage here is that this measure can adapt the indicator element to the particular weapon being used with a specific charge and thus the riflescope can be used for different weapons or if the charge is changed.

It can further be provided for an at least partially transparent hollow cylinder to be formed on which the reference marking is formed, whereby the hollow cylinder is coupled to the base and cannot be rotated relative to it, and for an indicator cylinder lying inside the hollow cylinder to be coupled rotationally to the rotary actuating element, whereby the indicator element of the indicator cylinder can be read off together with the reference marking of the hollow cylinder.

Alternately, it can be provided for an at least partially transparent hollow cylinder to be formed on which the indicator element is formed, whereby the hollow cylinder is rotationally coupled to the rotary actuating element, and for a reference component to be arranged inside the hollow cylinder on which the reference marking is arranged, whereby the reference component is coupled to the base.

The invention provides for a riflescope on which the invented adjusting element is arranged, for example as an elevation turret for vertical or as a side turret for horizontal adjustment of the line of sight.

Also provided is a weapon, in particular a gun, on which the invented riflescope with the invented adjusting element is arranged.

It can further be useful if the difference angle between the individual scale levels and/or the relative angle between two scale markings of a scale level is chosen according to the standard sighting in conditions typical for the gun.

The invention also provides for a method for adjusting a line of sight of an optical sighting mechanism, in particular a riflescope, using the invented adjusting element. The method comprises the following method steps:

- Identification of the current shot conditions that differ from the sighting in conditions, especially the shot distance;
- Determination of a required correction value for a main parameter, in particular by reading off from a table or a diagram or directly from an indicator element;
- Rotation of the rotary actuating element relative to the base to set a specific value of the main parameter required for correction, whereby the current setting of the rotary actuating element can be read off using the indicator element;
- Identification of the ancillary parameter applicable to the current shot conditions;
- Determination of a required correction value for the main parameter with the first ancillary parameter by reading off the correction value from the indicator element;
- Adjustment of the rotation angle setting of the rotary actuating element to correct the main parameter with the first ancillary parameter.

Instead of reading off the required correction value from a table or a diagram, practiced shooters can also memorize or estimate the required correction value.

The step—"Adjustment of the rotation angle setting of the rotary actuating element to correct the main parameter with the first ancillary parameter," can also be executed simultaneously with the step—"Rotation of the rotary actuating element relative to the base to set a specific value of the main parameter required for correction." In addition, the end position of the rotary actuating element to be achieved can already be read off from the indicator element and therefore stipulated before rotation of the rotary actuating element and taking into account the main parameter and the first ancillary parameter. Thus both the main parameter and the first ancillary parameter can be taken into account in only one process of setting the rotary actuating element.

It is further also conceivable that, as a first method step, a weapon on which the optical sighting mechanism is arranged is shot under certain sighting in conditions.

Determination of a required correction value of the main parameter can also be achieved by calculation using a ballistics program.

BRIEF DESCRIPTION OF THE DRAWINGS

To facilitate better understanding of the invention, it will be explained in detail using the figures below.

Extremely simplified, schematic depictions show the following.

DETAILED DESCRIPTION

In introduction, let it be noted that in the variously described embodiments, identical parts are provided with identical reference signs or identical part names, and that the disclosures contained in the description as a whole can be carried over analogously to identical parts with identical reference signs or identical part names. Likewise, positional information selected in the description, e.g. above, below, on the side, etc. refer to the directly described and depicted figure and if the position is changed, this positional information carries over analogously to the new position.

Figure 1:
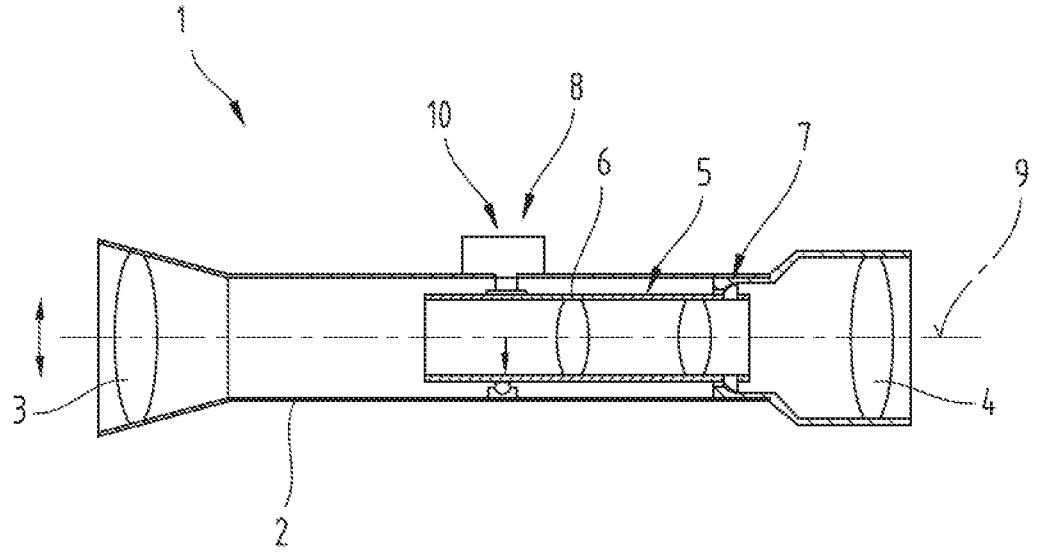
FIG. 1 is an example embodiment of a riflescope in a longitudinal section parallel to the axis of the line of sight.

FIG. 1 shows a very schematic depiction of a riflescope 1. The riflescope 1 preferably acts as a targeting mechanism on a gun. The riflescope 1 is arranged on the gun for this purpose.

The riflescope 1 comprises an external housing 2 in which an image-inverting system 5 is arranged between an objective 3 and an ocular 4 lens. The optical elements of the image-inverting system 5, e.g. two cemented lenses, sit inside an internal housing 6. The image-inverting system 5 is placed inside the external housing 2 on a mounting, e.g. ball socket, together with the internal housing 6 as a structural unit such that it can be rotated and/or tilted. This unit can be tilted by an adjustment made using an adjusting unit 8. This also changes the direction of a line of sight 9 that can be selectively adjusted using the adjusting unit 8.

To adjust the image-inverting system 5 inside the external housing 2, an adjusting element 10 that affects the image-inverting system 5, in particular an adjusting turret 10, is provided.

In alternative designs, the adjusting turret 10 can also work together with other optical components inside the external housing 2. So e.g. the objective lens 3 can be placed to be adjustable inside the external housing 2 in order to allow adjustment of the line of sight 9. The adjusting turret 10 could also be equipped to move a reticle. In yet another example embodiment, it is conceivable that the adjusting turret 10 can be used to adjust the entire external housing 2 relative to the gun to which the riflescope 1 is attached.

The riflescope 1 comprises at least one adjusting turret 10. This can, for example, be an elevation adjusting turret for vertical adjustment of the line of sight 9. In addition, a second adjusting turret 10 can be formed on the riflescope 1 for horizontal adjustment of the line of sight 9.

Figure 2:
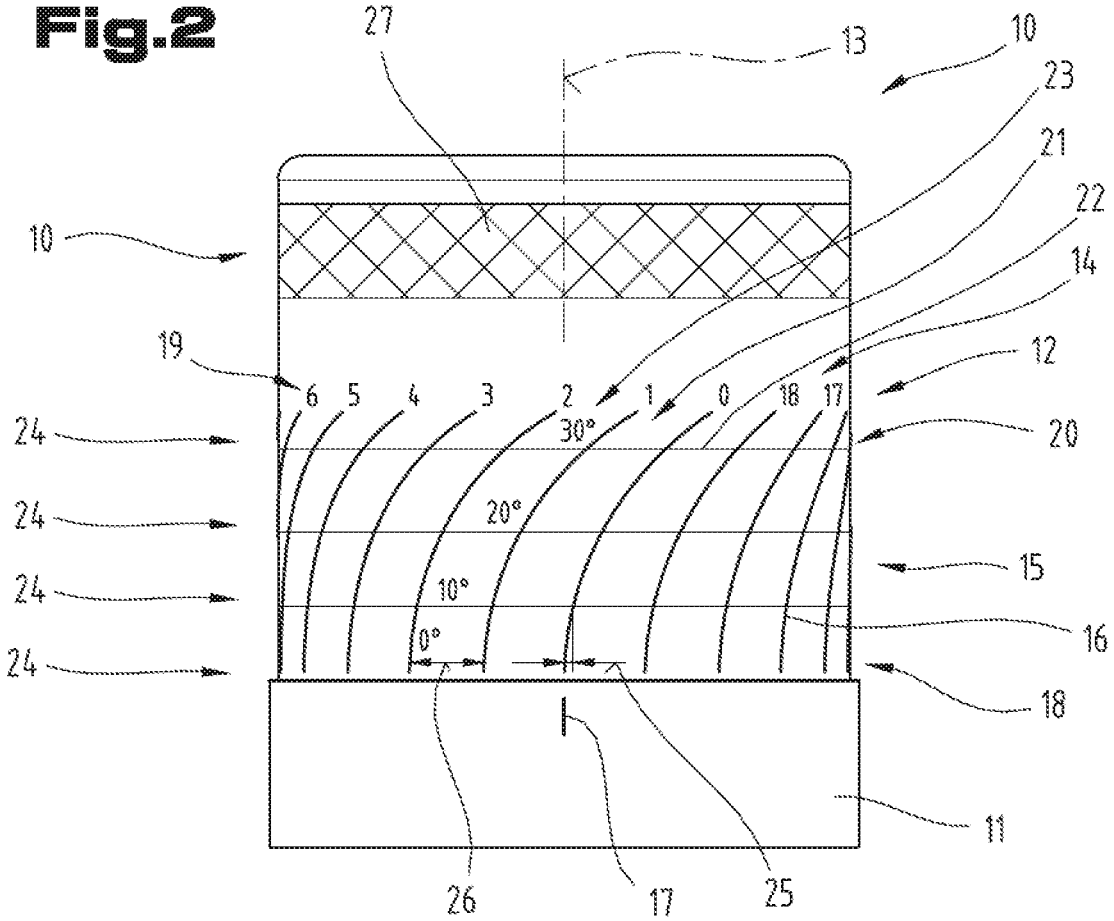
FIG. 2 is a schematic view of a first example embodiment of an adjusting element with option to set a main parameter and a first ancillary parameter.

FIG. 2 shows a schematic depiction of a possible example embodiment of the adjusting turret 10 . . . . As shown from FIG. 2, it can be provided for a rotary actuating element 12 to be arranged on a base 11 that can be rotated relative to the base 11 around an axis of rotation 13. The rotary actuating element 12 can be used to fix settings, in particular the angular tilt of the line of sight 9.

As apparent from FIG. 2, it can be provided for an indicator or display element 14 to be arranged directly on the rotary actuating element 12, by means of which the current setting of the rotary actuating element 12 can be read off. The indicator element 14 comprises a scale 15 with multiple scale markings 16. The scale markings 16 are to be read out by reference to a reference marking 17. As apparent from FIG. 2, it can be provided for the rotary actuating element 12 to be designed in the form of a cylinder, whereby the scale 15 and/or the scale markings 16 are printed directly on the circumferential surface of the circular cylinder. The base 11 can also be designed in the form of a circular cylinder, whereby the reference marking 17 can be printed or applied directly on the base 11.

The individual scale markings 16 represent values of a main parameter 18. The main parameter 18 can, for example, be printed in the form of multiples of 1 cm/100 m or MOA. This means that a rotation of the rotary actuating element 12 by an incremental value of a scale marking 16 produces a tilt of the line of sight 9 by a certain amount of angle. A relative angle 26 between two scale markings 16 placed next to each other is also called the resolution of the main parameter 18. As the rotary actuating element 12 is usually coupled to a detent ring that gives the user haptic and acoustic feedback when the next scale marking 16 is reached, adjustment by one scale marking 16 is also called a "click."

Different riflescopes 1 can have different resolutions for angle adjustment of the line of sight 9. Commonly used resolutions are, for example, for a click to correspond to 1 cm/100 m, 0.5 cm/100 m, 1 MOA, 1/2 MOA, 1/4 MOA or 1/8 MOA. Of course, other values such as 1/1000 rad etc. can also be used as resolution.

It can further be provided for the resolution of the main parameter 18 to be identified in a main parameter label 19.

It is further provided for not only the main parameter 18 to be shown on the indicator element 14, but for a first ancillary parameter 20 to be shown and therefore set as well. A first ancillary scale 21 can be provided that has multiple first ancillary scale markings 22. In addition, a first ancillary scale label 23 can be provided by means of which the ancillary parameter 20 can also be read off.

The ability to set the first ancillary parameter 20 can in particular by achieved by forming multiple scale levels 24 that are arranged axially spaced apart from each other on the indicator element 14. Between two neighboring scale levels 24, the scale markings 16 of the individual scale levels 24 representing the same value of the main parameter 18 are displaced from each other by a difference angle 25. This is an angle because the rotary actuating element 12 on which the indicator element 14 is arranged has a circular cylindrical surface. A parameter can be chosen as the first ancillary parameter 20 that only requires minor variation or a minor range of settings. A possible value that would, for example, be suited as the first ancillary parameter 20 is the shot angle.

The invention's design of the indicator element 14 allows a deviation from the main parameter 18 to be set in the first ancillary parameter 20. As apparently from FIG. 2, it can be provided for the scale markings 16 to be designed in the form of curves that extend beyond the individual scale levels 24. This increases clarity and makes reading off easier. As apparent from FIG. 2, the scale markings 16 can be arranged parallel to each other. It can in particular be provided for the scale markings 16 to be distributed evenly over the circumference of the rotary actuating element 12.

Alternately, it can of course also be provided for the scale marking 16 to be shown only in the form of points that are arranged in the individual scale levels 24.

It can further be provided for the rotary actuating element 12 to have a grip area 27 that is preferably spaced apart from the indicator element 14 and by which the user can grip the rotary actuating element 12.

Figure 3:
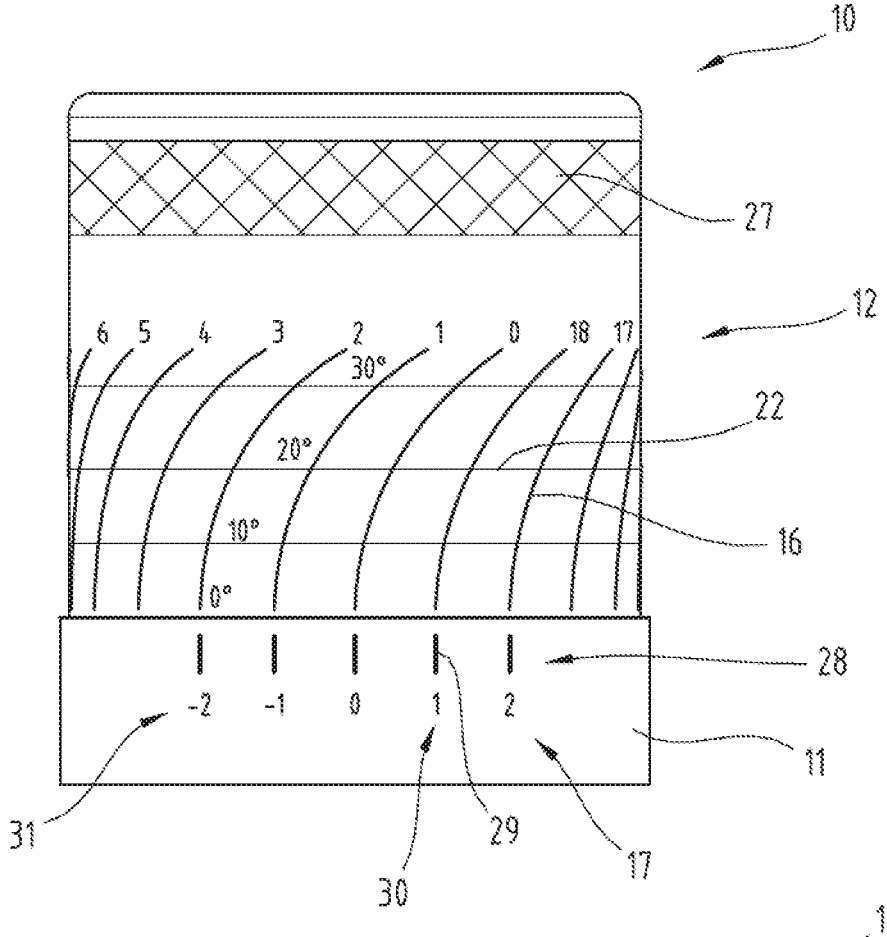
FIG. 3 is a schematic view of a second example embodiment of the adjusting element with option to set the main parameter, the first ancillary parameter, and a second ancillary parameter.

FIG. 3 depicts another, potentially independent embodiment of the adjusting turret 10, where once again the same reference signs and part names are used for the same parts as have been used in the preceding FIG. 2. To avoid unnecessary repetition, please refer to the detailed description in the above FIG. 2.

As apparent from FIG. 3, it can also be provided for the reference marking 17 not to comprise a single reference position but for a second ancillary scale 28 to be formed on the base 11 that has multiple second ancillary scale markings 29 and a second ancillary scale label 30. This way a second ancillary parameter 31 can be set.

The setting of the second ancillary parameter 31 is achieved in that the second ancillary scale markings 29 can realize a zero point offset when reading off the main parameter 18 and/or the main parameter 18 as influenced by the first ancillary parameter 20. A parameter can be chosen as the second ancillary parameter 31 that only requires minor variation or a minor range of settings. For example, it is conceivable for the air pressure and therefore the deviation in seeing height compared to sighting in conditions or a cartridge that differs from sighting in conditions to be set as the second ancillary parameter.

Figure 4:
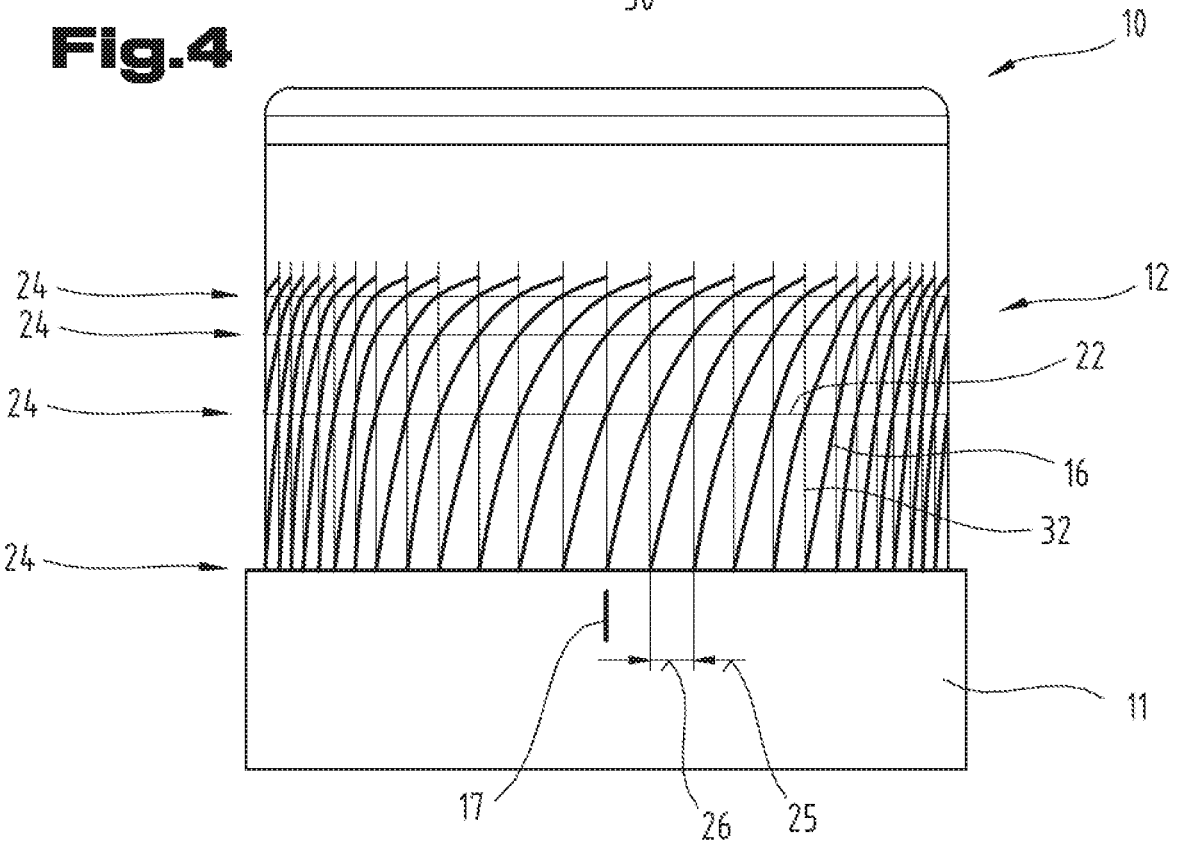
FIG. 4 is a schematic view of a third example embodiment of the adjusting element with auxiliary lines.

FIG. 4 depicts another, potentially independent embodiment of the adjusting turret 10, where once again the same reference signs and part names are used for the same parts as have been used in the preceding FIGS. 2 and 3. To avoid unnecessary repetition, please refer to the detailed description in the above FIGS. 2 and 3.

As apparent from FIG. 4, it can be provided that auxiliary lines parallel to the axis 32 are formed that extend the intersections of the scale markings 16 from the different scale levels 24 towards the reference marking 17. Here it is useful for the resolution of the first ancillary parameter 20 to be chosen such that the difference angle 25 between two scale markings 16 from two neighboring scale levels 24, which scale markings 16 represent the same value of the main parameter 18, is the same size or larger by an integer multiple than the resolution of the scale marking 16 of the main parameter 18. In the present example embodiment, the difference angle 25 and the relative angle 26 are the same size. This displaces the scale markings 16 from two spaced apart scale levels 24 that represent the same value of the main parameter 18 by exactly one click. This not only makes reading off easy, but also contributes to each scale marking that can be set on the whole indicator element 14 coinciding with a defined detent position.

The reference marking 17 can of course also indicator the second ancillary parameter 31 in this and in all other example embodiments just as in the example embodiment shown in FIG. 3.

To achieve a clear distribution of the auxiliary lines 32 as depicted in FIG. 4, it can be necessary to choose the values of the first ancillary parameter 20 such that the described shape results. This can also cause uneven or unusual values for the second ancillary parameter 31 to appear.

Figure 5:
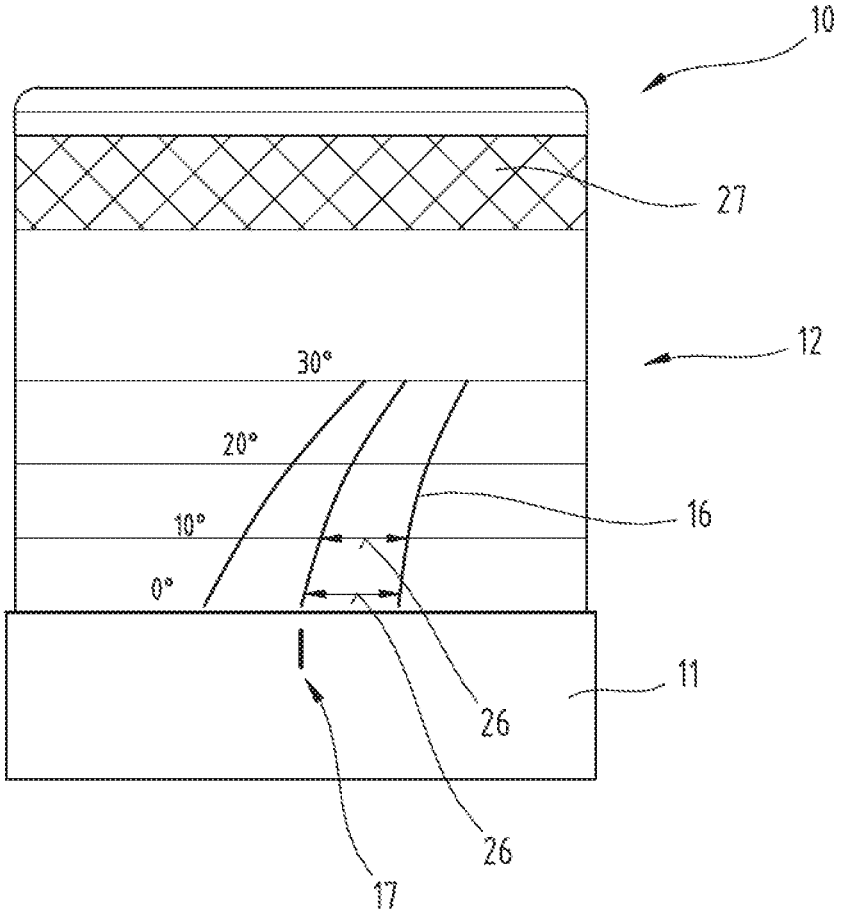
FIG. 5 is a schematic view of a fourth example embodiment of the adjusting element with curved lines of the main scale marking that have varying thicknesses.

FIG. 5 depicts another, potentially independent embodiment of the adjusting turret 10, where once again the same reference signs and part names are used for the same parts as have been used in the preceding FIGS. 2 to 4. To avoid unnecessary repetition, please refer to the detailed description in the above FIGS. 2 to 4.

As apparent from FIG. 5, it can also be provided for the individual curves of the scale markings 16 to not be arranged to run parallel to each other, but for the relative angle 26 between two neighboring scale markings 16 of a first scale level 24 to be a different size from the relative angle 26 between two neighboring scale markings 16 on a second scale level 24. This takes into account, for example, that if the shot angle is steeper, a shot distance that differs from the sighting in conditions makes only a minor adjustment to the tilt of the line of sight 9 necessary than would, for example, be necessary for a horizontal shot.

In the interests of clarity, only three scale markings 16 are shown on the present indicator element 14 according to FIG. 5. It is self-evident that of course this type of scale marking 16 can be arranged distributed around the entire circumference, with the curvature of the individual scale markings 16 becoming ever larger.

Figure 6:
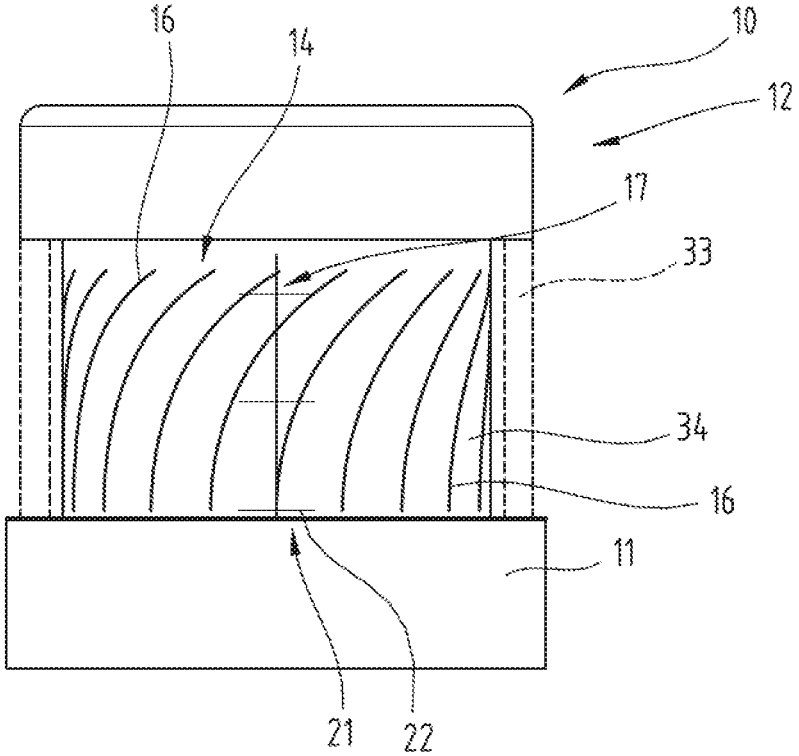
FIG. 6 is a schematic view of a fifth example embodiment of the adjusting element with a transparent hollow cylinder.

FIG. 6 depicts another, potentially independent embodiment of the adjusting turret 10, where once again the same reference signs and part names are used for the same parts as have been used in the preceding FIGS. 2 to 5. To avoid unnecessary repetition, please refer to the detailed description in the above FIGS. 2 to 5.

As apparent from FIG. 6, it can be provided for a hollow cylinder 33 to be formed that is transparent and that is coupled to the base 11 without the ability to be rotated. The reference marking 17 can be printed or arranged on the surface of the hollow cylinder 33. Furthermore, the first ancillary scale 21 with the corresponding first ancillary scale markings 22 can be printed on the hollow cylinder 33. An indicator cylinder 34 can be placed inside the hollow cylinder 33 and rotationally coupled to the rotary actuating element 12. The indicator element 14, in particular the scale markings 16, can be printed on the indicator cylinder 34.

This design makes the individual scale levels 24 easy to read off.

The hollow cylinder 33 can be made of, for example, glass or a transparent plastic material.

It can further be provided for the hollow cylinder 33 with the indicator element 14 arranged on it to be able to be rotated by a certain value relative to the base 11, whereby the reference marking 17 is displaced and the second ancillary parameter 31 can be set.

Figure 7:
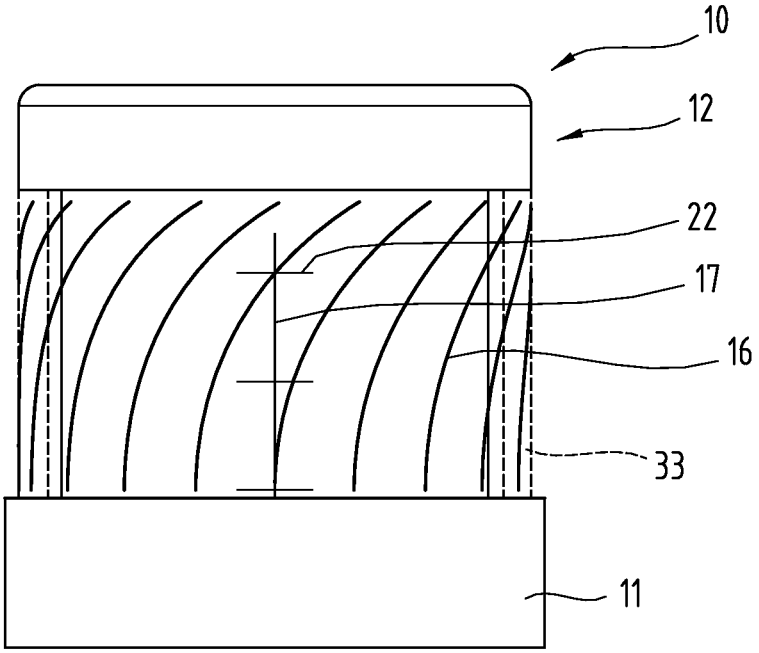
FIG. 7 is a schematic view of a sixth example embodiment of the adjusting element with a transparent hollow cylinder.

FIG. 7 depicts another, potentially independent embodiment of the adjusting turret 10, where once again the same reference signs and part names are used for the same parts as have been used in the preceding FIGS. 2 to 6. To avoid unnecessary repetition, please refer to the detailed description in the above FIGS. 2 to 6.

The example embodiment as in FIG. 7 is similar to the example embodiment as in FIG. 6. In this example embodiment, the indicator element 14, in particular the scale markings 16, is printed on the hollow cylinder 33, whereby the hollow cylinder 33 is rotationally coupled to the rotary actuating element 12. The reference marking 17 is located on a reference component 35 that is non-rotationally coupled to the base 11. The individual scale levels 24 can also be marked on the reference component 35.

Figure 8A:
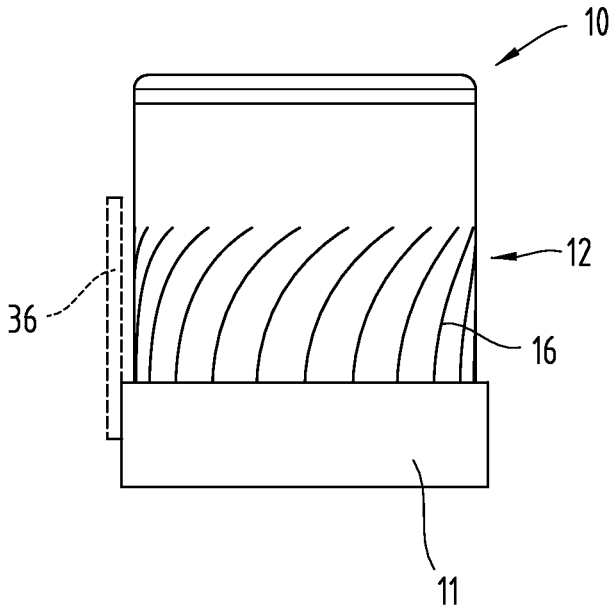
FIG. 8A is a schematic side view of a seventh example embodiment of the adjusting element with a reading aid.
Figure 8B:
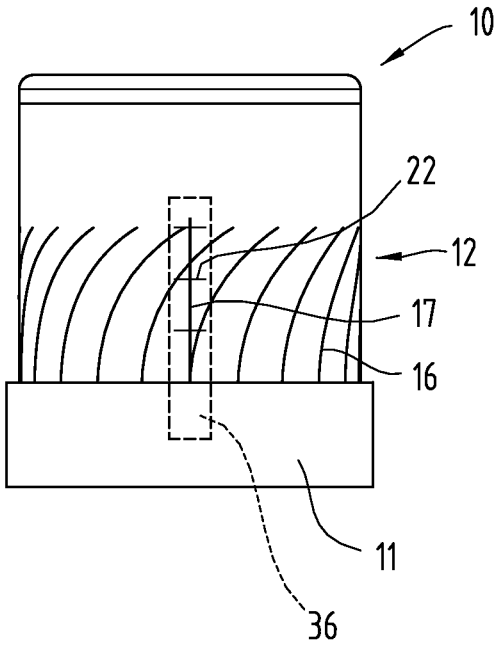
FIG. 8B is a schematic front view of the adjusting element of FIG. 8A.

FIGS. 8A and 8B depict another, potentially independent embodiment of the adjusting turret 10, where once again the same reference signs and part names are used for the same parts as have been used in the preceding FIGS. 2 to 7. To avoid unnecessary repetition, please refer to the detailed description in the above FIGS. 2 to 7.

FIG. 8A depicts the adjusting turret 10 in a side view. FIG. 8B depicts the adjusting turret 10 in the associated front view.

The example embodiment according to FIGS. 8A and 8B include a reading aid 36 that is arranged directly on the base 11. The reading aid 36 is preferably formed of a transparent material. The reference marking 17 or, optionally, the first ancillary scale markings 22 are arranged on the reading aid 36.

The reading aid 36 extends beyond the individual scale levels 24, making it easier to read off all scale levels 24.

Figure 9A:
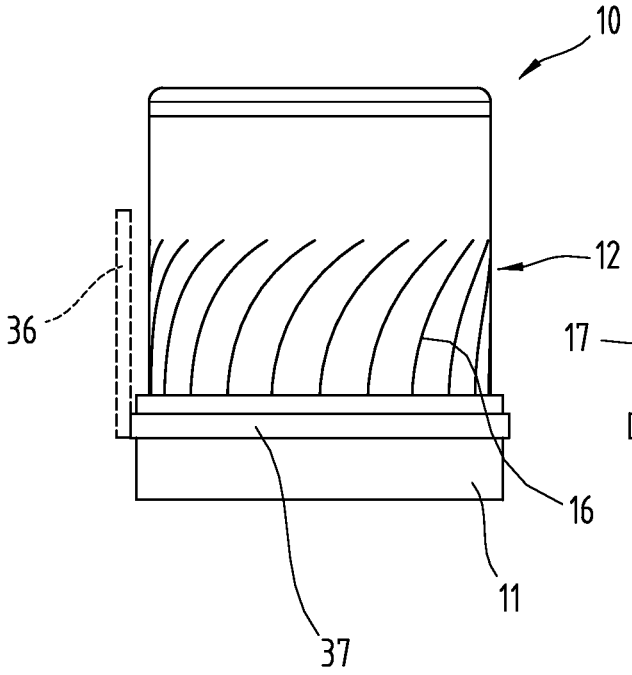
FIG. 9A is a schematic side view of an eighth example embodiment of the adjusting element with an adjustable reading aid.
Figure 9B:
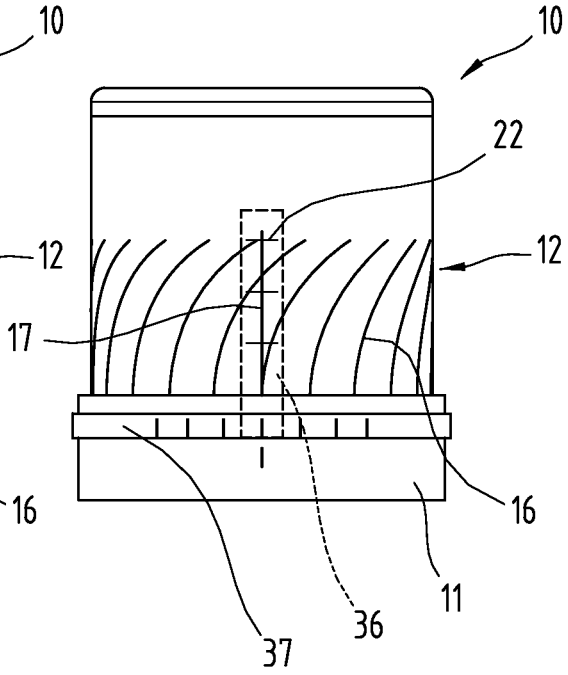
FIG. 9B is a schematic front view of the adjusting element of FIG. 9B.

FIGS. 9A and 9B depict another, potentially independent embodiment of the adjusting turret 10, where once again the same reference signs and part names are used for the same parts as have been used in the preceding FIGS. 2 to 8. To avoid unnecessary repetition, please refer to the detailed description in the above FIGS. 2 to 8.

FIG. 9A depicts the adjusting turret 10 in a side view. FIG. 9A depicts the adjusting turret 10 in the associated front view.

The example embodiment in FIGS. 9A and 9B is formed similarly to the example embodiment in FIGS. 8A and 8B, where in this example embodiment the reading aid 36 is not arranged directly on the base 11, but is arranged on a swivel 37 that can be rotated relative to the base 11. This way the second ancillary parameter 31 can be set.

To illustrate the invention's scale marking, the following example will show how the shot angle influences the correction needed for a successful shot at different ranges of fire. Calculations were done using a commercial ballistics software like QuickTARGET, based on the following assumptions: Standard ICAO atmosphere; sighting in distance: 100 m; Height of line of sight above the barrel: 5 cm; 1 click: 1 cm/100 m; Charge: SAKO 0.308 WIN 141A Racehead, v0=820 m/s, BC=0.480

Using this data, the required correction for a successful shot can be calculated for different shot angles, for uphill shots in the following.

Figure 10:
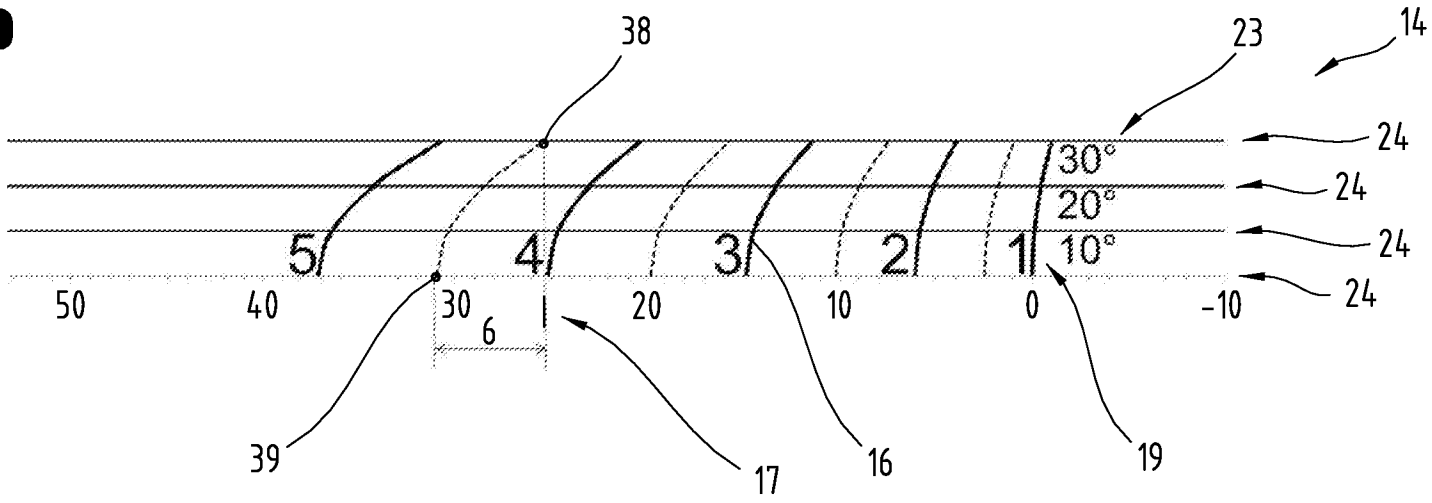
FIG. 10 is a schematic view of a first example embodiment of a flat projection of the indicator element.

The indicator element 14 could be formed as shown in a flat projection in FIG. 10.

The correction value in clicks for the above parameters can be required as shown in the table, where the first row of the table shows different shot angles and the first column of the table shows different shot distances:

| | 0° | 10° | 20° | 30° |
|---|---|---|---|---|
| 100 m | 0 | 0 | 0 | −1 |
| 150 m | 3 | 2 | 2 | 1 |
| 200 m | 6 | 6 | 5 | 4 |
| 250 m | 10 | 10 | 9 | 7 |
| 300 m | 15 | 14 | 13 | 11 |
| 350 m | 20 | 19 | 18 | 16 |
| 400 m | 25 | 25 | 23 | 20 |
| 450 m | 31 | 30 | 28 | 25 |
| 500 m | 37 | 36 | 34 | 31 |

If the main parameter 18 is set to be the successful shot distance and the first ancillary parameter 20 is set to be the shot angle according to table 1, this results in four scale levels 24 that visually illustrate the scale markings 16 depicted as curved lines in FIG. 10. Shown is the level flat projection of the cylindrical indicator element 14, where the numbers '1', '2', . . . '5' assign the successful shot distances 100 m, 200 m, . . . 500 m associated with the scale markings. The dotted lines represent the corresponding intermediate distances 150 m, 250 m to 450 m. The horizontal lines correspond to the ancillary parameters of 10°, 20° and 30° shot angle. For better understanding, on the lowest scale level there is also shown the number of clicks as they correspond to the actual incremental rotation of the turret. To now correct the main parameter 18 to match the first ancillary parameter 20, the shooter follows the scale marking corresponding to the shot distance along the various scale levels 24 until the scale level 24 matches the current shot angle and readjusts the rotary actuating element 12 accordingly.

FIG. 10 depicts a required correction for a shot at 450 m at an angle of 30°, which correspond to the point in reference sign 38. This is compared to a shot at 450 m at an angle of 0°, which corresponds to the point in reference sign 39.

The curvature of the scale markings 16 thus results in a correction of 6 clicks by which the turret must be turned back for a successful shot. Conversely, it can be read off from this example that, without correction, this shot angle would have led to a high shot of 1 cm/100 m/click×450 m×6 clicks=27 cm, which would no longer have been tolerable from a hunting point of view. If the values of main and ancillary parameter that need correction do not fall on or directly next to a scale marking 16, the shooter must visually interpolate the values.

Another example will show how the invention's scale marking 16 can be applied in the case of the side turret. As shooters know adequately well, a cross-wind has considerable influence on hitting the target. Practiced shooters take this into account based on experience by compensating by aiming to the side. Less practiced shooters often find it difficult to estimate the required correction, as both the distance to the goal and the strength of the cross-wind must be taken into account. Assuming the parameters for the charge listed for table 1, the influence of the cross-wind can be calculated using a ballistics program.

Figure 11:
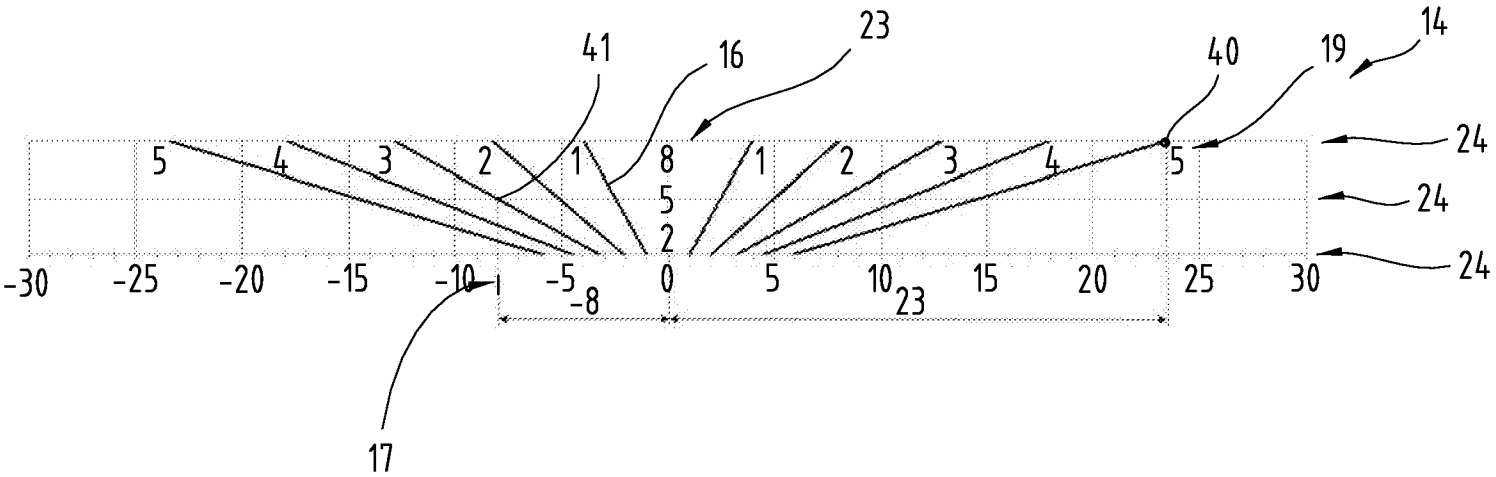
FIG. 11 is a schematic view of a second example embodiment of a flat projection of the indicator element.

The indicator element 14 could be formed as shown in a flat projection in FIG. 11.

The correction value in clicks for the above parameters can be required as shown in the table, where the first row of the table shows different wind speeds and the first column of the table shows different shot distances:

| | 2 m/s | 5 m/s | 8 m/s |
|---|---|---|---|
| 100 m | 1 | 2 | 4 |
| 200 m | 2 | 5 | 8 |
| 300 m | 3 | 8 | 13 |
| 400 m | 4 | 11 | 18 |
| 500 m | 6 | 15 | 23 |

In this example embodiment, the main parameter 18 is the successful shot distance and the first ancillary parameter 20 is the cross-wind, whereby here three scale levels 24 were taken into account for the first ancillary parameter 20 with three different wind forces. In this example, the three wind forces were chosen so that a connection between the correction values for a specific distance and an even scale marking 16 results. As a cross-wind is possible from both sides, i.e. from the right or from the left of the shot distance, adjustment via the side turret is typically provided symmetrically around a zero point.

This is apparent in FIG. 11, as the scale markings 16 are reflected around the zero point. Positive values mean that in this example the rotary actuating element 12 must be turned counter-clockwise, which corresponds to tilting the line of sight to the right and is necessary to compensate for a cross-wind from the right. Negative values mean exactly the opposite for compensation for a cross-wind from the left.

Similar to FIG. 10, FIG. 11 depicts the flat projection of the cylindrical indicator element 14, where the scale markings 16 are based on the values from the above table. The numbers '1', '2', . . . '5' correspond to the successful shot distances of 100 m, 200 m, . . . 500 m associated with the scale markings 16. The labelling of the three scale levels with '2', '5', and '8' corresponds to a cross-wind of 2 ms/, 5 m/s, and 8 m/s. The actual click values are shown on the x-axis for better understanding.

As FIG. 11 shows, to compensate for a cross-wind from the right of 8 m/s at 500 m shot range—reference sign 40—a rotation of the rotary actuating element 12 of 23 clicks counter-clockwise is needed.

In case of a cross-wind from the left of 5 m/s at a shot distance of 350 m—reference sign 41—a rotation of the rotary actuating element 12 of −8 clicks, i.e. clockwise, is needed.

Using these values, it is easy to calculate that without a corresponding lateral correction, the target would have been missed by 1 cm/100 m/click×500 m×23 clicks=115 cm given a wind of 8 m/s and 500 m shot range, or by 1 cm/100 m/click×350 m×8 clicks=28 cm given 5 m/s and 350 m.

As is particularly apparent from FIGS. 10 and 11, it is conceivable in all example embodiments for the scale markings 16 and/or their spacing from each other not to correspond to the clicks, i.e. the resolution of the adjustability of the rotary actuating element 12, but for already pre-defined values to be represented in the scale markings 16. Resolution of the clicks of the rotary actuating element 12 can be stated in a separate label that can differ from the main parameter label 19.

The example embodiments show possible variations; let it be noted at this juncture that the invention is not limited to the specially portrayed variations of embodiments themselves, but that diverse combinations of the individual variations of embodiments are possible and that this possibility of variation falls within the competence of a person active in this technical field based on the teaching regarding technical action provided by this invention.

The scope of protection is determined by the claims. However, the description and the drawings should be used to interpret the claims. Individual characteristics or combinations of characteristics from the depicted and described various example embodiments can constitute independent inventive solutions. The aim underlying the independent invented solutions can be taken from the description.

All information regarding ranges of values in this description should be understood to mean that these include any and all partial ranges, e.g. the statement 1 to 10 should be understood to mean that all partial ranges starting from the lower threshold 1 and the upper threshold 10 are included, i.e. all partial ranges begin with a lower threshold of 1 or larger and with an upper threshold of 10 or less, e.g. 1 to 1.7 or 3.2 to 8.1 or 5.5 to 10.

As a matter of form, let it be noted that, to facilitate a better understanding of the design, elements have in places been portrayed not to scale and/or enlarged and/or scaled-down.

The invention claimed is:

1. An adjusting element for adjustment of a line of sight of a rifle scope, comprising:

a base having a reference marking thereon, a rotary actuating element rotatable around an axis of rotation relative to the base, the rotary actuating element being a rotary actuating knob defined by an outer circumferential surface, and an indicator element rotatable around the axis of rotation relative to the base and along a circumference of the base, the indicator element being visible from the outside and having at least one scale with multiple individual scale markings, the multiple individual scale markings configured to be read in reference to the reference marking, wherein the indicator element is coupled to the rotary actuating element, the indicator element being visible with reference to the reference marking and configured to display a current setting of the rotary actuating element, wherein the individual scale markings represent values of a main parameter, wherein in order to take into consideration a first ancillary parameter at least two scale levels are formed, wherein each of the at least two scale levels are arranged on the indicator element axially spaced apart from each other, wherein scale markings of the individual scale levels representing the same value of the main parameter are displaced from each other by a difference angle, the main parameter being correctable according to the first ancillary parameter by using the individual scale levels, wherein the individual scale markings are continuous arcuate curves extending between and beyond the individual scale levels.

2. The adjusting element according to claim 1, wherein the indicator element is arranged directly on the rotary actuating element.

3. The adjusting element according to claim 1, wherein the ancillary parameter and the main parameter represent different parameters.

4. The adjusting element according to claim 1, wherein the relative angle between two scale markings of a first scale level is different to a relative angle between two scale markings of a second scale level.

5. The adjusting element according to claim 1, wherein auxiliary lines parallel to the axis are arranged on the indicator element that extend at least some of the scale markings from the individual scale levels towards the reference marking.

6. The adjusting element according to claim 1, wherein the individual scale levels are characterized by axially spaced apart circumferentially running ancillary scale markings.

7. The adjusting element according to claim 5, wherein the scale markings, the auxiliary lines parallel to the axis, and the ancillary scale markings have any of a different color and a different line thickness.

8. The adjusting element according to claim 1, wherein the reference marking has a second ancillary scale and thus a second ancillary parameter can be set, whereby the second ancillary scale of the reference marking acts to offset a zero point based on the second ancillary parameter.

9. The adjusting element according to claim 1, wherein a resolution of the first ancillary parameter is chosen such that the difference angle between two scale markings from two neighboring scale levels, which scale markings represent the same value of the main parameter, is the same size or larger by an integer multiple than a relative angle of the scale marking of the main parameter.

10. The adjusting element according to claim 1, further comprising a transparent reading aid coupled to the base and extending outside the indicator element beyond the individual scale levels of the indicator element, whereby the reference marking is designed in the form of a stripe parallel to an axis applied on the reading aid.

11. The adjusting element according to claim 10, wherein the ancillary scale markings of the individual scale levels are formed on the reading aid.

12. The adjusting element according to claim 10, further comprising a swivel wherein the reading aid is arranged on the swivel that can be rotated relative to the base, allowing the second ancillary parameter to be set.

13. The adjusting element according to claim 1, wherein the indicator element comprises an at least partially transparent material on which the individual scale markings are applied and the reference marking takes the form of a stripe parallel to the axis arranged behind the indicator element that extends beyond the individual scale levels of the indicator element.

14. The adjusting element according to claim 1, further comprising an at least partially transparent hollow cylinder on which the reference marking is formed, where the hollow cylinder is coupled to the base and cannot be rotated relative to it, a display cylinder is arranged inside the hollow cylinder and is coupled rotationally to the rotary actuating element, where the indicator element of the display cylinder can be read together with the reference marking of the hollow cylinder.

15. The adjusting element according to claim 1, further comprising an at least partially transparent hollow cylinder on which the indicator element is formed, where the hollow cylinder is rotationally coupled to the rotary actuating element, and a reference component is arranged inside the hollow cylinder on which the reference marking is arranged, where the reference component is coupled to the base.

16. A riflescope with at least one adjusting element of claim 1 for adjustment of the line of sight by adjustment of at least one optical component inside the riflescope.

17. The adjusting element according to claim 1, wherein the indicator element is exchangeable so that different indicator elements including different scale markings and/or scale levels are attachable to the rotary actuating element.

18. A method for adjustment of a line of sight of an optical sighting mechanism using the adjusting element according to claim 1, wherein the method comprises:

identification of current shot conditions that differ from sighting in conditions, wherein the sighting in conditions include a shot distance;

determination of a required correction value for a main parameter by reading off from any of a table, a diagram or directly from an indicator element;

rotation of the rotary actuating element relative to the base to set a specific value of the main parameter required for correction, whereby the current setting of the rotary actuating element can be read off using the indicator element;

identification of the first ancillary parameter applicable to the current shot conditions, wherein individual levels are arranged on the indicator element axially spaced apart from each other at a fixed distance; and determination of a required correction value for the main parameter with the first ancillary parameter by reading off the correction value from the indicator element;

adjustment of a rotation angle setting of the rotary actuating element to correct the main parameter with the first ancillary parameter.

19. An adjusting element for adjustment of a line of sight of a rifle scope, comprising:

a base having a reference marking thereon, a rotary actuating element that can be rotated around an axis of rotation relative to the base, the rotary actuating element being a rotary actuating knob defined by an outer circumferential surface, and an indicator element coupled to the rotary actuating element and adapted to be rotated along with the rotary actuating element around the axis of rotation relative to the base, the indicator element having a plurality of scale markings used in conjunction with the reference marking to indicate a current setting, wherein each of the scale markings represents a values of a main parameter, wherein in order to take into account a first ancillary parameter at least two scale levels are formed, wherein each of the at least two scale levels are arranged on the indicator element axially spaced apart at an axial distance from each other, wherein scale markings of the individual scale levels representing the same value of the main parameter are displaced from each other by a difference angle, and the main parameter can be corrected with the first ancillary parameter by using the individual scale levels arranged on the same indicator element axially spaced apart at an axial distance, wherein the scale markings are continuous arcuate curves extending between and beyond the scale levels.

20. An adjusting element for adjustment of a line of sight of a rifle scope, comprising:

a base having a reference marking thereon, a rotary actuating element that can be rotated around an axis of rotation relative to the base, the rotary actuating element being a rotary actuating knob defined by an outer circumferential surface, and an indicator element that can be rotated around the axis of rotation relative to the base and has at least one scale with multiple individual scale markings, wherein the indicator element is coupled to the rotary actuating element, and the indicator element is visible with reference to the reference marking and acts to display a current setting of the rotary actuating element, wherein the individual scale markings represent values of a main parameter, wherein in order to take into account a first ancillary parameter at least two scale levels are formed, wherein each of the at least two scale levels are arranged on the same indicator element axially spaced apart at an axial distance from each other, wherein scale markings of the individual scale levels representing the same value of the main parameter are displaced from each other by a difference angle, and the main parameter can be corrected with the first ancillary parameter by using the individual scale levels arranged on the same indicator element axially spaced apart at an axial distance, wherein the individual scale markings extend as continuous arcuate curves between and beyond the individual scale levels.

* * * * *